US010063954B2

(12) United States Patent
Neumeyer et al.

(10) Patent No.: US 10,063,954 B2
(45) **Date of Patent: *Aug. 28, 2018**

(54) HEARING DAMAGE LIMITING HEADPHONES

(71) Applicant: III Holdings 4, LLC, Wilmington, DE (US)

(72) Inventors: Frederick Charles Neumeyer, Austin, TX (US); Samir Ibrahim, Memphis, TN (US); John Michael Page Konx, Austin, TX (US)

(73) Assignee: III HOLDINGS 4, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/804,694

(22) Filed: Nov. 6, 2017

(65) Prior Publication Data

US 2018/0063619 A1 Mar. 1, 2018

Related U.S. Application Data

(63) Continuation of application No. 14/853,904, filed on Sep. 14, 2015, now Pat. No. 9,813,792, which is a continuation of application No. 13/176,738, filed on Jul. 5, 2011, now Pat. No. 9,167,339.

(60) Provisional application No. 61/362,211, filed on Jul. 7, 2010.

(51) Int. Cl.
*H04R 29/00* (2006.01)
*H04R 1/10* (2006.01)

(52) U.S. Cl.
CPC ..... *H04R 1/10* (2013.01); *H04R 1/1091* (2013.01)

(58) Field of Classification Search
None
See application file for complete search history.

(56) References Cited

U.S. PATENT DOCUMENTS 3,350,643 A 10/1967 Webb
4,845,755 A 7/1989 Busch et al.
4,947,432 A 8/1990 Topholm
(Continued)

FOREIGN PATENT DOCUMENTS

DE 19542961 C1 5/1997
GB 2473664 B 1/2010
(Continued)

OTHER PUBLICATIONS

Gary P. Rodriguez et al., "Preferred Hearing Aid Response Characteristics Under Acoustic and Telecoil Coupling conditions" Nov. 1993, American Journal of Audiology, 55-59, Retrieved from http://aja.pubs.asha.org on Apr. 13, 2016.
(Continued)

*Primary Examiner* — James Mooney
(74) *Attorney, Agent, or Firm* — Polsinelli PC

(57) ABSTRACT

A device includes an input for receiving an audio signal, a speaker to convert the audio signal into an audible sound, and a memory for storing remediation instructions and detection instructions. The device further includes a processor coupled to the input, the speaker, and the memory. The processor is configured to process the audio signal according to the detection instructions and the remediation instructions to modulate amplitude of the audio signal based on the remediation instructions.

20 Claims, 6 Drawing Sheets

(56) References Cited

U.S. PATENT DOCUMENTS

| | | | |
|---|---|---|---|
| 4,972,487 | A | 11/1990 | Mangold et al. |
| 5,107,473 | A | 4/1992 | Fuji et al. |
| 5,130,665 | A | 7/1992 | Walden |
| 5,148,153 | A | 9/1992 | Haymond |
| 5,303,306 | A | 4/1994 | Brillhart et al. |
| 5,450,494 | A | 9/1995 | Okubo et al. |
| 5,524,056 | A | 6/1996 | Killion et al. |
| 5,524,150 | A | 6/1996 | Sauer |
| 5,563,951 | A | 10/1996 | Wang et al. |
| 5,608,803 | A | 3/1997 | Magotra et al. |
| 5,651,073 | A | 7/1997 | Isu et al. |
| 5,661,812 | A | 8/1997 | Scofield et al. |
| 5,666,426 | A | 9/1997 | Helms |
| 5,692,058 | A | 11/1997 | Eggers et al. |
| 5,721,783 | A | 2/1998 | Anderson |
| 5,727,070 | A | 3/1998 | Coninx |
| 5,734,731 | A | 3/1998 | Marx |
| 5,734,964 | A | 3/1998 | Fishman et al. |
| 5,734,976 | A | 3/1998 | Bartschi et al. |
| 5,764,775 | A | 6/1998 | Kim |
| 5,768,397 | A | 6/1998 | Fazio |
| 5,802,183 | A | 9/1998 | Scheller et al. |
| 5,812,598 | A | 9/1998 | Sharma et al. |
| 5,824,022 | A | 10/1998 | Zilberman et al. |
| 5,867,581 | A | 2/1999 | Obara |
| 5,873,126 | A | 2/1999 | Singh et al. |
| 6,078,675 | A | 6/2000 | Bowen-Nielsen et al. |
| 6,151,400 | A | 11/2000 | Seligman |
| 6,330,339 | B1 | 12/2001 | Ishige et al. |
| 6,532,294 | B1 | 3/2003 | Rudell |
| 6,694,034 | B2 | 2/2004 | Julstrom et al. |
| 6,741,712 | B2 | 5/2004 | Bisgaard |
| 6,794,852 | B2 | 9/2004 | Tran |
| 6,920,229 | B2 | 7/2005 | Boesen |
| 7,010,133 | B2 | 3/2006 | Chalupper et al. |
| 7,050,907 | B1 | 5/2006 | Janky et al. |
| 7,167,571 | B2 | 1/2007 | Bantz et al. |
| 7,301,305 | B2 | 11/2007 | Tran |
| 7,324,650 | B2 | 1/2008 | Fischer et al. |
| 7,336,227 | B2 | 2/2008 | Durst et al. |
| 7,397,217 | B2 | 7/2008 | Van Brocklin et al. |
| 7,446,505 | B2 | 11/2008 | Paul et al. |
| 7,451,256 | B2 | 11/2008 | Hagen et al. |
| 7,499,686 | B2 | 3/2009 | Sinclair et al. |
| 7,519,194 | B2 | 4/2009 | Niederdrank et al. |
| 7,529,545 | B2 | 5/2009 | Rader et al. |
| 7,561,708 | B2 | 7/2009 | Röhrlein |
| 7,593,822 | B2 | 9/2009 | Stewart et al. |
| 7,610,035 | B2 | 10/2009 | Van Bosch et al. |
| 7,640,101 | B2 | 12/2009 | Pair et al. |
| 7,676,335 | B2 | 3/2010 | Ahmed et al. |
| 7,715,576 | B2 | 5/2010 | Ribic |
| 7,778,432 | B2 | 8/2010 | Larsen |
| 7,787,647 | B2 | 8/2010 | Hagen et al. |
| 7,826,631 | B2 | 11/2010 | Fischer et al. |
| 7,853,028 | B2 | 12/2010 | Fischer |
| 7,929,722 | B2 | 4/2011 | Shridhar et al. |
| 7,933,419 | B2 | 4/2011 | Roeck et al. |
| 8,170,884 | B2 | 5/2012 | Vaudrey et al. |
| 8,265,315 | B2 | 9/2012 | Sørensen |
| 8,379,871 | B2 | 2/2013 | Michael et al. |
| 8,457,335 | B2 | 6/2013 | Imamura et al. |
| 8,515,110 | B2 | 8/2013 | Neumeyer |
| 8,526,649 | B2 | 9/2013 | Foo et al. |
| 8,611,570 | B2 | 12/2013 | Neumeyer et al. |
| 8,649,538 | B2 | 2/2014 | Apfel et al. |
| 8,654,999 | B2 | 2/2014 | Mindlin, II et al. |
| 8,761,421 | B2 | 6/2014 | Apfel |
| 8,787,603 | B2 | 7/2014 | Fichtl et al. |
| 8,810,392 | B1 | 8/2014 | Teller et al. |
| 9,071,917 | B2 | 6/2015 | Neumeyer et al. |
| 9,167,339 | B2 | 10/2015 | Knox et al. |
| 9,191,756 | B2 | 11/2015 | Neumeyer et al. |
| 9,462,397 | B2 | 10/2016 | Neumeyer et al. |
| 2003/0008659 | A1 | 1/2003 | Waters et al. |
| 2003/0055537 | A1 | 3/2003 | Odinak et al. |
| 2003/0059076 | A1 | 3/2003 | Martin |
| 2003/0069704 | A1 | 4/2003 | Bean |
| 2003/0215105 | A1 | 11/2003 | Sacha |
| 2004/0059446 | A1 | 3/2004 | Golberg et al. |
| 2004/0199146 | A1 | 10/2004 | Rogers et al. |
| 2005/0036637 | A1 | 2/2005 | Janssen |
| 2005/0277994 | A1 | 12/2005 | McNamee et al. |
| 2005/0281424 | A1 | 12/2005 | Rass |
| 2006/0182294 | A1 | 8/2006 | Grabson et al. |
| 2006/0198530 | A1 | 9/2006 | Fischer et al. |
| 2007/0014423 | A1 | 1/2007 | Darbut et al. |
| 2007/0098195 | A1 | 5/2007 | Holmes |
| 2007/0214893 | A1 | 9/2007 | Killion |
| 2007/0254728 | A1 | 11/2007 | Moallemi et al. |
| 2007/0255435 | A1 | 11/2007 | Cohen et al. |
| 2007/0274531 | A1* | 11/2007 | Camp ..... H04R 5/04 381/74 |
| 2008/0037797 | A1* | 2/2008 | Goldstein ..... A61B 5/121 381/56 |
| 2008/0136654 | A1 | 6/2008 | Toriello et al. |
| 2008/0137873 | A1* | 6/2008 | Goldstein ..... H04R 1/1016 381/57 |
| 2008/0167531 | A1 | 7/2008 | McDermott |
| 2008/0240477 | A1 | 10/2008 | Howard et al. |
| 2009/0074216 | A1 | 3/2009 | Bradford et al. |
| 2009/0208024 | A1 | 8/2009 | Farver et al. |
| 2009/0262964 | A1 | 10/2009 | Havenith et al. |
| 2009/0290721 | A1 | 11/2009 | Goldstein et al. |
| 2010/0027822 | A1 | 2/2010 | Dietz |
| 2010/0054511 | A1 | 3/2010 | Wu et al. |
| 2010/0073749 | A1 | 3/2010 | Noh et al. |
| 2010/0202637 | A1 | 8/2010 | Cornelisse et al. |
| 2010/0255782 | A1 | 10/2010 | Klemmensen |
| 2010/0273452 | A1 | 10/2010 | Rajann et al. |
| 2010/0296668 | A1 | 11/2010 | Lee et al. |
| 2011/0176697 | A1 | 7/2011 | Apfel et al. |
| 2011/0200215 | A1 | 8/2011 | Apfel et al. |
| 2011/0243345 | A1 | 10/2011 | Carreras et al. |
| 2011/0249836 | A1 | 10/2011 | Solum et al. |
| 2012/0082329 | A1 | 4/2012 | Neumeyer et al. |
| 2012/0130660 | A1 | 5/2012 | Neumeyer |
| 2013/0301860 | A1 | 11/2013 | Neumeyer et al. |
| 2014/0003641 | A1 | 1/2014 | Neumeyer et al. |
| 2015/0256946 | A1 | 9/2015 | Neumeyer et al. |

FOREIGN PATENT DOCUMENTS

| | | | |
|---|---|---|---|
| WO | 1998043192 | A1 | 1/1998 |
| WO | 2006117365 | A1 | 11/2006 |
| WO | 2008071236 | A2 | 6/2008 |
| WO | 2009001559 | A1 | 12/2008 |
| WO | 2011159349 | A1 | 12/2011 |

OTHER PUBLICATIONS

Non-Final Office Action dated Jun. 4, 2013 from U.S. Pat. No. 8,611,570 Patent Prosecution History.

Response to Jun. 4, 2013 Final Office Action filed Aug. 16, 2013 from U.S. Pat. No. 8,611,570 Patent Prosecution History.

Certified English Translation of WO/2009/001559, Oct. 20, 2016.

Prosecution History of U.S. Pat. No. 6,694,034, filed on Dec. 28, 2000, issued on Feb. 17, 2004.

Tooley, Michael, "Data Communications Pocket Book" 2nd Edition 1989, 1992, Butterworth-Heinemann Ltd, Linacre House, Jordan Hill Oxford OX2 8DP.

Patent File History of U.S. Pat. No. 7,929,722, filed on Nov. 18, 2008, issued on Apr. 19, 2011.

Patent File History of U.S. Pat. No. 8,170,884, filed on Jan. 8, 2008, issued on May 1, 2012.

Parker, Sybil P., "McGraw-Hill Dictionary of Scientific and Technical Terms", Fifth Edition, 1974, 1994, McGraw-Hill, USA.

Petition for Inter Partes Review of U.S. Pat. No. 9,191,756, filed Jan. 27, 2017.

Declaration of Robert K. Morrow Ph.D., filed in Petition for Inter Partes Review of U.S. Pat. No. 9,191,756, filed Jan. 27, 2017.

(56) References Cited

OTHER PUBLICATIONS

Petition for Inter Partes Review of U.S. Pat. No. 8,654,999, filed Jan. 27, 2017.
Declaration of Les Atlas Ph.D., filed in Petition for Inter Partes Review of U.S. Pat. No. 8,654,999, filed Jan. 27, 2017.
Petition for Inter Partes Review of U.S. Pat. No. 8,761,421, filed Dec. 21, 2016.
Declaration of Robert E. Morley, Jr. D.Sc. filed in Petition for Inter Partes Review of U.S. Pat. No. 8,761,421, filed Dec. 21, 2016.
Petition for Inter Partes Review of U.S. Pat. No. 7,640,101, filed Dec. 12, 2016.
Declaration of Sayfe Kiaei Ph.D. filed in Petition for Inter Partes Review of U.S. Pat. No. 7,640,101, filed Dec. 12, 2016.
Petition for Inter Partes Review of U.S. Pat. No. 8,649,538, filed Dec. 6, 2016.
Declaration of Les Atlas Ph.D., filed in Petition for Inter Partes Review of U.S. Pat. No. 8,649,538, filed Dec. 6, 2016.
Petition for Inter Partes Review of U.S. Pat. No. 8,611,570, filed Dec. 6, 2016.
Declaration of Sayfe Kiaei Ph.D. filed in Petition for Inter Partes Review of U.S. Pat. No. 8,611,570, filed Dec. 6, 2016.
Petition for Inter Partes Review of U.S. Pat. No. 6,694,034, filed Jan. 3, 2017.
Declaration of Robert E. Morley, Jr. D.Sc. filed in Petition for Inter Partes Review of U.S. Pat. No. 6,694,034, filed Jan. 3, 2017_.
Declaration of Les Atlas Ph.D., filed in Petition for Inter Partes Review of U.S. Pat. No. 7,929,722, filed Feb. 17, 2017.
Petition for Inter Partes Review of U.S. Pat. No. 8,170,884, filed Feb. 21, 2017.
Declaration of Sayfe Kiaei Ph.D. filed in Petition for Inter Partes Review of U.S. Pat. No. 8,170,884, filed Feb. 21, 2017.
Deposition Transcript of Clyde "Kip" M. Brown, Jr., filed in Exhibits for Inter Partes Review of U.S. Pat. No. 8,761,421, filed Dec. 28, 2017.
Reply Declaration of Robert E. Morley, Jr., D. Sc., filed in Exhibits Inter Partes Review of U.S. Pat. No. 8,761,421, filed Dec. 28, 2017.
Robert E. Morley, Jr., D. Sc. Deposition Transcript, filed in Exhibits Inter Partes Review of U.S. Pat. No. 8,761,421, filed Feb. 20, 2018.
Deposition Transcript of Clyde "Kip" M. Brown, Jr., filed in Exhibits for Inter Partes Review of U.S. Pat. No. 8,654,999, filed Feb. 12, 2018.
Berger, Elliott, "Dangerous Decibels: How Loud is Too Loud", http://dangerousdecibels.org/education/information-center/decibel-exposure-time-guidelines/.
United States Patent and Trademark Office, Final Office Action, U.S. Appl. No. 13/007,568, dated May 30, 2013, 18 pages.
United States Patent and Trademark Office, Final Office Action, U.S. Appl. No. 13/176,738, dated May 22, 2014, 10 pages.
United States Patent and Trademark Office, Final Office Action, U.S. Appl. No. 13/290,269, dated May 1, 2015, 22 pages.
United States Patent and Trademark Office, Final Office Action, U.S. Appl. No. 13/708,009, dated Jul. 30, 2014, 8 pages.
United States Patent and Trademark Office, Final Office Action, U.S. Appl. No. 13/935,744, dated Jun. 10, 2015, 9 pages.
International Searching Authority/United States, International Search Report and Written Opinion, PCT Patent Application PCT/US2011/001077, dated Nov. 15, 2011, 9 pages.
United States Patent and Trademark Office, Non-Final Office Action, U.S. Appl. No. 13/007,568, dated Dec. 12, 2012, 18 pages.
United States Patent and Trademark Office, Non-Final Office Action, U.S. Appl. No. 13/176,738, dated Feb. 18, 2015, 5 pages.
United States Patent and Trademark Office, Non-Final Office Action, U.S. Appl. No. 13/176,738, dated Jan. 16, 2014, 12 pages.
United States Patent and Trademark Office, Non-Final Office Action, U.S. Appl. No. 13/176,738, dated Jul. 18, 2013, 15 pages.
United States Patent and Trademark Office, Non-Final Office Action, U.S. Appl. No. 13/290,269, dated Nov. 18, 2014, 19 pages.
United States Patent and Trademark Office, Non-Final Office Action, U.S. Appl. No. 13/708,009, dated Jan. 21, 2014, 6 pages.
United States Patent and Trademark Office, Non-Final Office Action, U.S. Appl. No. 13/935,744, dated Aug. 7, 2015, 9 pages.
United States Patent and Trademark Office, Non-Final Office Action, U.S. Appl. No. 13/935,744, dated Dec. 26, 2014, 6 pages.
United States Patent and Trademark Office, Non-Final Office Action, U.S. Appl. No. 13/935,744 dated Feb. 20, 2015, 9 pages.
United States Patent and Trademark Office, Notice of Allowance, U.S. Appl. No. 13/007,568, dated Feb. 14, 2014, 5 pages.
United States Patent and Trademark Office, Notice of Allowance, U.S. Appl. No. 13/176,738, dated Jun. 17, 2015, 9 pages.
United States Patent and Trademark Office, Notice of Allowance, U.S. Appl. No. 13/244,260, dated May 1, 2013, 5 pages.
United States Patent and Trademark Office, Notice of Allowance, U.S. Appl. No. 13/708,009, dated Feb. 27, 2015, 6 pages.
GN ReSound Group, USA. ReSound Alera: End User Brochure. Instructional brochure M101100-GB-10.02 Rev. A, 2010, 7 pages.
United States Patent and Trademark Office, Restriction Requirement, U.S. Appl. No. 13/708,009, dated Nov. 28, 2014, 5 pages.
United States Patent and Trademark Office, Restriction Requirement, U.S. Appl. No. 13/935,744, dated Oct. 10, 2014, 6 pages.
United States Patent and Trademark Office, Restriction Requirement, U.S. Appl. No. 14/719,544, dated Aug. 27, 2015, 5 pages.
United States Patent and Trademark Office, Non-Final Office Action, U.S. Appl. No. 13/290,269, dated Feb. 1, 2016, 27 pages.
United States Patent and Trademark Office, Non-Final Office Action, U.S. Appl. No. 14/719,544, dated Mar. 28, 2016, 5 pages.
United States Patent and Trademark Office, Notice of Allowance, U.S. Appl. No. 13/935,744, dated Jun. 2, 2016, 9 pages.
United States Patent and Trademark Office, Notice of Allowance, U.S. Appl. No. 14/719,544, dated Jul. 13, 2016, 5 pages.
United States Patent and Trademark Office, Final Office Action, U.S. Appl. No. 13/290,269, dated Sep. 19, 2016, 34 pages.
File History of U.S. Pat. No. 9,191,756, filed on Dec. 7, 2012, issued on Nov. 17, 2015.
American Heritage Dictionary, published in 2011, p. 1652.
Barron's Dictionary of Computer and Internet Terms, published in 2013, p. 457.
Ira Sager, "Before IPhone and Android Came Simon, the First Smartphone", Jun. 29, 2012; Retrieved from www.bloomberg.com on Jan. 23, 2017.
Taylor Martin, "The Evolution of the Smartphone", Jul. 29, 2014; Retrived from www.pocketnow.comon Jan. 23, 2017.
Sangeeta Mukherjee, "Smartphone Evolution from IBM Simon to Samsung-Galaxy S3", May 8, 2012; Retrieved rom www.ibtimes.com on Jan. 23, 2017.
B. Kasoff, "A Closer Look the Evolution of the SmartPhone", Sep. 19, 2014; Retrieved from www.blog.wipp.org on Jan. 23, 2017.
File History of U.S. Pat. No. 8,654,999, filed on Apr. 12, 2011, issued Feb. 18, 2014.
Michael Valente, "Guideline for Audiologic Management of the Adult Patient", Oct. 30, 2006; Retrieved from https://www.audiologyonline.com on Dec. 14, 2016.
ISA Good Practice Guidance, "Good Practice Guidance for Adult Hearing Aid Fittings and Services—Background to the Document and Consultation", Nov. 2004.
Gitte Keidser et al., "Variation in Preferred Gain with the Experience for Hearing-Aid User", 2008, International Journal of Audiology 47:10, 621-635, retrieved from University of Washington Libraries on Jan. 4, 2017.
Harvey Dillon, et al., "The Trainable Hearing Aid: What will it do for clients and clinicians?", The Hearing Journal 59:4, 30-36, Apr. 2006.
Non-Final Office Action dated Dec. 12, 2012 from U.S. Appl. No. 13/007,568 Patent Prosecution History.
Response to Dec. 12, 2012 Non-Final Office Action filed Mar. 1, 2013 from U.S. Pat. No. 8,761,421 Patent Prosecution History.
Final Office Action dated May 30, 2013 from U.S. Pat. No. 8,761,421 Patent Prosecution History.
Response to May 30, 2013 Final Office Action filed Jul. 9, 2013 from U.S. Pat. No. 8,761,421 Patent Prosecution History.
File History of U.S. Pat. No. 7,640,101, filed on Jun. 24, 2004, issued on Dec. 29, 2009.

(56) References Cited

OTHER PUBLICATIONS

Richard B. Langley, "NMEA 0183: A GPS Receiver Interface Standard", (1995) GPS World, 54-57.
Ken Lassesen, "Creating 16-Bit and 32-Bit Screen Savers with Visual Basic" Jun. 29, 1995, Microsoft Developer Network Technology Group, Retrieved from http://msdn.microsoft.com on Oct. 20, 2007.
Prosecution History of U.S. Pat. No. 8,649,538, filed on Feb. 8, 2011, issued Feb. 11, 2014.
Consumer Reports,—"Hear Well in a Noisy World"—Features at a glance, Jul. 2009, Consumer Reports Magazine, Retrieved from www.consumerreports.org on Nov. 18, 2016.

* cited by examiner

HEARING DAMAGE LIMITING HEADPHONES

CROSS REFERENCE TO RELATED APPLICATION(S)

This application is a continuation of U.S. patent application Ser. No. 14/853,904, filed Sep. 14, 2015, now U.S. Pat. No. 9,813,792, which is a continuation of U.S. patent application Ser. No. 13/176,738, filed Jul. 5, 2011, now U.S. Pat. No. 9,167,339, which is a non-provisional of and claims priority to U.S. Provisional Patent App. No. 61/362,211, filed Jul. 7, 2010, each of which are incorporated herein by reference in their entireties.

FIELD

This disclosure relates generally to headphones for listening to sounds, such as music. More particularly, this disclosure generally relates to headphones configured to automatically limit possible hearing damage by controlling characteristics of the sound output.

BACKGROUND

Exposure to audio signals at greater and greater amplitudes through the use of headphones and media devices, such as cell phones and MP3 players, has been increasing at an alarming rate. Exposure to audio signals at high decibel levels has been determined to be one of the primary causes of age-related permanent hearing impairment. However, hearing impairment is not only increasing in the general population, but is increasing at a significantly faster rate among young people, especially in among those who utilize media devices and wear headphones (or wireless earpieces) for significant amounts of time.

The extent of hearing damage sustained through exposure to sounds has been determined to be a function of both the amplitude and the duration of the audio signals, and particularly exposure to audio signals at amplitudes that exceed a safe acoustic threshold. Permanent hearing damage is a cumulative effect of exceeding the minimum thresholds or safe pressure levels for extended periods. Safe listening durations at various amplitudes can be calculated by averaging audio output levels over time to yield a time-weighted average. Various administrative bodies (such as the Occupational Safety and Health Administration (OSHA)) and health awareness agencies (such as the National Institute for Occupational Safety and Health (NIOSH)) have adopted guidelines for safe acoustic levels that arc based on an eight hour work day. However, such guidelines were not necessarily designed to address the most common source of acoustic damage, namely headphones.

Unfortunately, most common media devices and their associated headphones encourage listening to music at volume levels well above the safe acoustic threshold set, for example, by OSHA. Such volume levels may have no immediate effect on hearing, but long-term exposure can nevertheless cause permanent hearing impairment.

To help prevent hearing damage, some devices have been developed to periodically measure sound levels of ambient audio signals. Such measurements can be used to estimate a cumulative effect of the ambient audio signals over time. However, such devices often simply notify the user when they have exceeded the OSHA or NIOSH guidelines for acoustic exposure. Unfortunately, these devices typically provide no preventative measures for the device user. Further, such devices are often worn in place of headphones, making the two devices incompatible. Some headphones utilize a predetermined maximum output level in an attempt to limit the output amplitude to prevent ear damage. This approach, however, is ineffective as it does not take into account listening duration and the calculation of risk for auditory injury over time.

Other devices have been developed to be placed as an accessory between the media player and the earphones increasing earphone impedance as the decibel level increases. This approach, however, is limited, in part, because such devices cannot be calibrated for the speakers in the headphones. As a result, these devices may either limit the audio output too much or not enough.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Sound (or noise) dosimeters are devices used to measure sound levels or sound pressure levels over time to estimate the noise exposure of a person. Studies indicate that sustained exposure to noise levels in excess of 85 dB and/or short and loud noises above a peak threshold can permanently damage hearing. To protect workers from acoustic exposure-based hearing impairment, the European Community, for example, adopted a rule that no worker, while on the job, should he exposed to an acoustic pressure of more than about 200 Pa, which equates to approximately 140 dB.

Dosimeters have been developed that can be worn on the user's belt and/or worn as a badge or pin on the user's clothing. Such devices can be configured to measure sound parameters and to warn the person when the decibel level exceeds a safe threshold level. Most sound pressure level dosimeters are meant to be worn all day and to monitor all audio signals to which the dosimeter is exposed. However, this is often impractical because such devices are not discrete and are not necessarily designed to measure the types of sounds that tend to cause the most damage. For many people, especially young people, the most damaging audio signals are delivered by media players configured to reproduce sounds at high decibel levels for short periods of time, often through headphones that deliver sound signals directly into the user's ear canal, which sound signals cannot be measured by such noise dosimeters.

Embodiments of a headphone system are disclosed below that. are configured to monitor audio levels over Lime and to adjust the audio levels appropriately to prevent the headphone system from permanently damaging the hearing of the user. In a particular embodiment, the system includes a dosimeter to monitor acoustic exposure and logic to selectively adjust audio output levels over time based on the acoustic exposure. By providing a sound pressure level dosimeter in the headphones and by allowing automatic adjustment of the audio output levels, a large percentage of hearing damage caused by headphone usage can be prevented, even if the dosimeter is not designed to monitor ambient noise and other non-headphone produced noise to which the user may he exposed.

Figure 1:
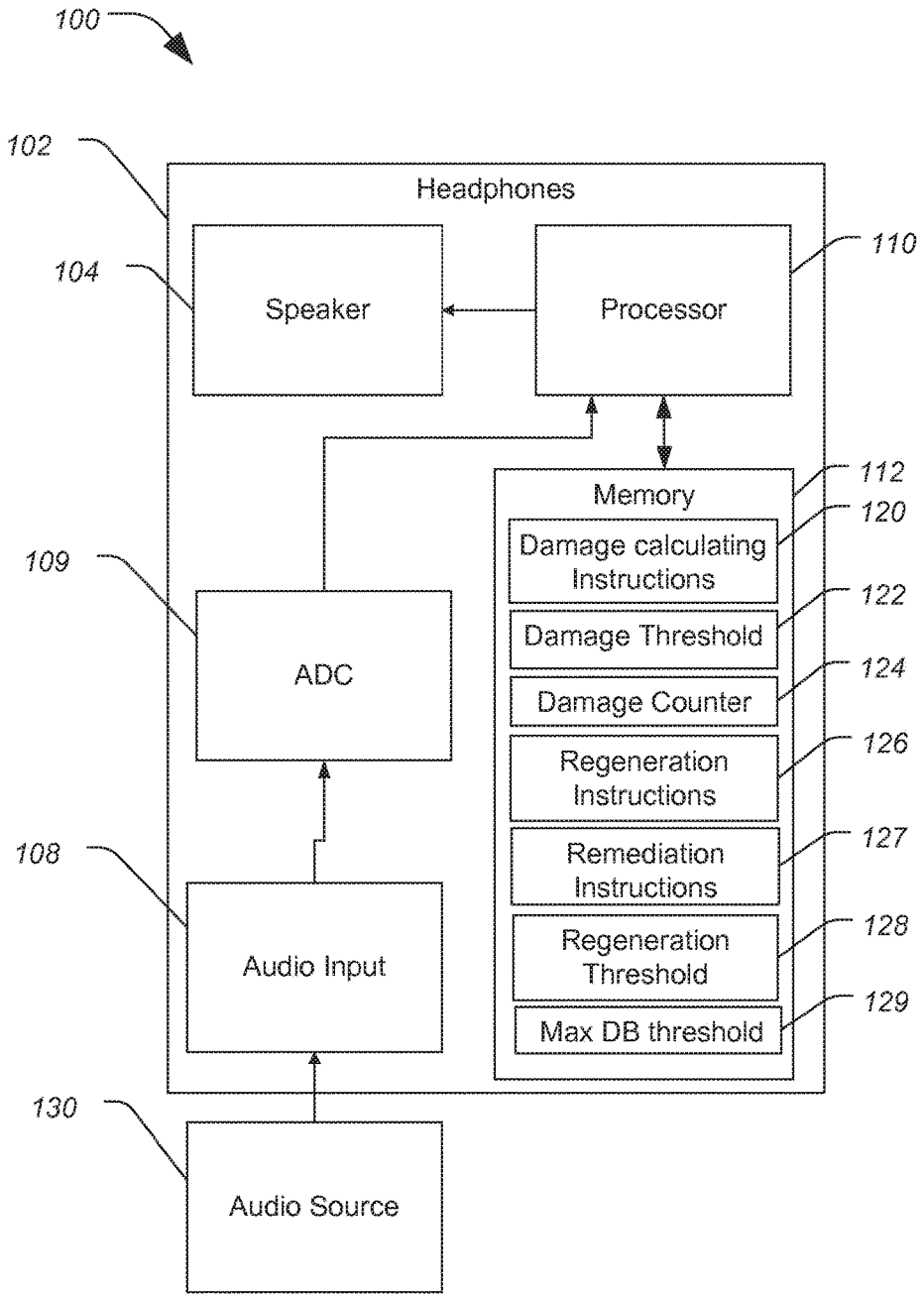
FIG. 1 is a block diagram of an embodiment of a headphone system configured to limit hearing damage.

FIG. 1 is a block diagram of a headphone system 100 configured to automatically limit hearing damage. Headphone system 100 includes headphones 102 coupled to an audio source 130. Headphones 102 include an audio input 108 for receiving an audio signal from audio source 130. Headphones 102 may also include an analog-to-digital converter 109 including an input coupled to an output of audio input 108 and an output coupled to an input of a processor 110. Processor 110 is coupled to memory 112 and to speaker 104. Memory 112 includes instructions and data that can be executed or processed by processor 110. Such instructions and data include damage calculating instructions 120, damage threshold 122, damage counter 124, regeneration instructions 126, remediation instructions 127, regeneration threshold data 128, and maximum (max) DB threshold data 129, and optionally other thresholds and/or other instructions.

Damage calculating instructions 120 are executable by processor 110 to calculate the hearing damage per second caused by the audio signal's current decibel level. Damage threshold 122 includes a numerical representation of the amount of hearing damage a user's ear can absorb before the damage becomes permanent. Damage counter 124 includes instructions for accumulating an amount of damage attributable to the acoustic exposure of the user and a numerical value of the amount of damage the user has sustained from listening to audio signals reproduced by speaker 104 using headphone system 100.

It should be appreciated that, in some instances, the ear can repair or regenerate itself through periods of low noise (i.e., noise levels below a safe hearing threshold) or no noise. Such regeneration takes time. Regeneration calculating instructions 126 are executable by processor 110 to calculate the amount of regeneration or repair that the user's ear has achieved over time. Remediation instructions 127 are executable by processor 110 to reduce the amplitude of or to otherwise modify the audio signal as the user listens to headphones 102. As discussed below in greater detail, remediation instructions 127 may be programmed in a number of ways to provide a variety of listening options to the user. Regeneration threshold data 128 includes a numerical value representing the decibel level at which the damage caused by the audio signal is less than the regeneration rate of the user's ear. Max DR threshold data 129 is a numerical value representing a peak decibel level the ear can handle before instantaneous hearing loss occurs.

In one embodiment, the count of damage counter 124 is originally set to zero as if the user's ears are fully repaired (i.e., in a fully regenerated, no-hearing-impairment state). As, an audio signal is received from audio source 130 at audio input 108, the audio signal is converted to a digital signal for processing by processor 110. Processor 110 monitors the amplitude of the audio signal and executes damage calculating instructions 120 to determine the damage over time caused by the decibel level of the audio signal as it is reproduced for the user. Using the damage calculating instructions 120, processor 110 converts the amplitude of the audio signal to a decibel level to obtain the damage per second at that decibel level. It is important to understand that the higher the amplitude of the audio signal, the higher the sound pressure level becomes and the more damage that is caused per second to a user's ear. Processor 110 uses damage calculating instructions 120 to determine the damage per second and to calculate the damage to the user's ear based on the amount of time the decibel level is maintained, and adds the resulting data to damage counter 124 to indicate the current state of the user's hearing.

Processor 110 also executes regeneration instructions 126. Regeneration instructions 126 model the regeneration rate of the human ear, so after the user listens to audio signals, which can cause degeneration, the human ear is capable of repairing the damage at a determinable rate. Further, while the ear is exposed to sounds below the regeneration threshold 128, the ear may repair itself. Regeneration instructions 126 model the regeneration rate of the human ear by subtracting the regeneration per second from damage counter 124. It should be noted that the damage rate and the regeneration rate are both impacted by the amplitude of the audio signals, such that the rates will vary over time. Thus, as damage calculating instructions 120 add damage to damage counter 124, regeneration instructions 126 may subtract damage. The addition and subtraction of damage may occur at different rates depending on the audio level. In this way, damage counter 124 models the total hearing damage that actually occurred to the ear at any time during the period in which the user listens to audio output from speaker 104.

As previously discussed, prolonged exposure to noise levels above a safe acoustic threshold can cause permanent hearing impairment. Accordingly, as damage counter 124 approaches a permanent hearing threshold included within the damage threshold 122, processor 110 selectively executes remediation instructions 127 to reduce the amplitude of the audio signal. Such remediation instructions 127 can include various steps or options, which may be executed at different stages as the damage counter 124 approaches the permanent hearing loss threshold.

In a particular example, processor 110 executes remediation instructions 127 when damage counter 124 reaches or is about to exceed the damage threshold 122. At this point, remediation instructions 127 cause the processor 110 to adjust the decibel level of the audio signal to a safe level that is below the regeneration threshold 128 and to limit the decibel level of the audio signal to that safe level until at least a portion of the hearing damage is repaired as modeled by the regeneration instructions 126. In one example, remediation instructions 127 cause processor 110 to reduce the decibel level before damage counter 124 equals or exceeds damage threshold 122. By reducing the decibel level before damage counter 124 reaches damage threshold 122, system 100 may retain a hearing buffer to protect the user's hearing in case the user is exposed to other sound signals outside of the control of system 100.

In a second example, remediation instructions 127 cause processor 110 to gradually decrease the amplitude of the audio signal over time in proportion to the distance between the damage counter 124 and the damage threshold 122. The gradual decrease of the amplitude may be a substantially linear decrease or a non-linear adjustment that decreases the decibel level more rapidly as the damage counter 124 approaches the damage threshold 122. By gradually decreasing the decibel level as the damage counter 124 approaches the damage threshold 122, the user can listen to the audio signal longer at levels above safe hearing levels without causing permanent damage.

In another particular embodiment, processor 110 executes remediation instructions 127 to change the amplitude of the audio signal over time to fit a curve based on the original decibel level of the audio signal and a determined time period for listening. The curve is a pre-configured output curve designed to extend the amount of time the user can utilize system 100 at higher decibel and amplitude levels by lengthening the time it takes for the damage counter 124 to reach damage threshold 122. The time period may be predetermined (such as the average listening time of a normal user), set by the user, determined from the user's normal listening behavior, or any combination thereof.

Remediation instructions 127 may be programmed or configured by a user to reduce the volume below regeneration threshold 128 before damage counter 124 reaches damage threshold 122. In one particular example, processor 110 executes remediation instructions 127 to calculate a decibel adjustment curve, which processor 110 can use to adjust the audio output signal such that the decibel level of the audio signal drops below regeneration threshold 128 when damage counter 124 reaches a specified percentage of damage threshold 122.

In yet another example, remediation instructions 127 cause processor 110 to use a stepped approach to limiting hearing damage. In this example, processor 110 executes remediation instructions 127 to determine a series of decibel levels based on the original decibel level of the audio signal, which step down incrementally from the original decibel level over time so that the audio level is reduced incrementally as damage counter 124 increases. After a first period of time, processor 110 executes remediation instructions 127 to reduce the audio signal by a first increment, and then allows the user to listen to the audio signal at that decibel level until damage counter 124 reaches a specified fraction of damage threshold 122. After the specified fraction is reached or exceeded, processor 110 executes remediation instructions 127 to decrease the decibel level of the audio output by another incremental step. In a particular example, if there were four steps, processor 110 can decrement the decibel level by a step when damage counter 124 equals one fourth of damage threshold 122, one-half of damage threshold 122, three fourths of damage threshold 122, and so on. When the damage counter 124 approaches the damage threshold 122, processor 110 executes remediation instructions 127 to decrease the decibel level to a safe decibel level that is below regeneration threshold 128.

In yet another example, remediation instructions 127 cause processor 110 to use scale the amplitude based on the rate of change of the damage counter 124. This function may be linear, stepped, or exponential as described above but the rate at which the amplitude is adjusted down is based on the value of the damage counter 124.

In all of the above examples, once the decibel level is reduced below the regeneration threshold 128, processor 110 is configured to limit the audio signal to the safe decibel level until damage counter 124 indicates that regeneration has reached a predetermined fraction of damage threshold 122. For example, system 100 may use remediation instructions 127 to increase the decibel level again once damage counter 124 falls to 50% of damage threshold 122.

It should be understood that system 100 may also be designed to decrement the damage counter 124. In this instance, damage counter 124 may be originally set at damage threshold 122, and the damage counter 124 is reduced during operation based on damage calculating instructions 120 and is increased by regeneration instructions 126. In this instance, other remediation instructions (such as incrementally adjusting or limiting the audio signal as the damage counter 124 approaches the damage threshold 122) would be changed such that the remediation instructions 127 would cause the processor 110 to limit the decibel level of the audio signal as the damage counter 124 decreases.

While FIG. 1 depicts a headphone system 100 that uses a processor 110 adapted to implement damage limiting instructions to selectively reduce an audio output of headphones 102 digitally, it is also possible to implement a headphone system that can limit the decibel level of the audio signal using analog circuitry. An example of such a headphone system is described below with respect to FIG. 2.

Figure 2:
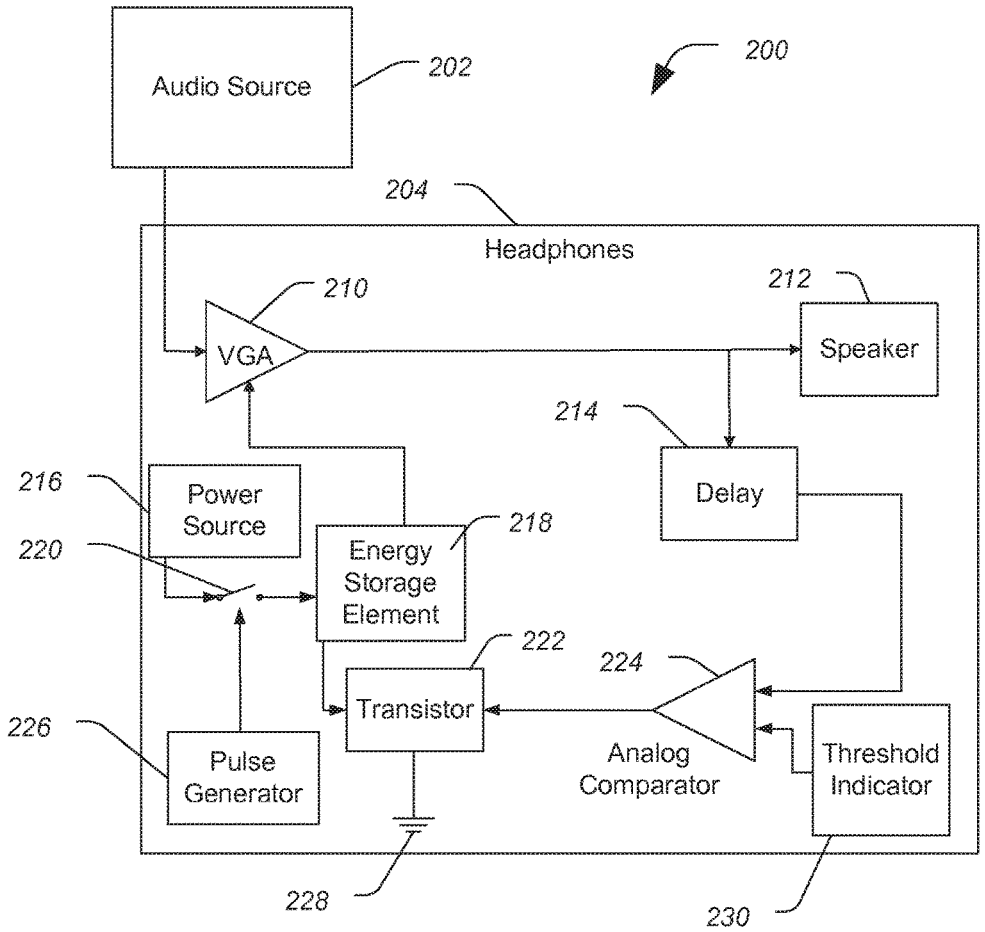
FIG. 2 is a block diagram of an embodiment of an analog design of the headphone system of FIG. 1.

FIG. 2 is a block diagram of an embodiment of an analog design of a headphone system 200 configured to limit hearing damage. System 200 is designed such that, when the user listens to an audio signal having a decibel level above the regeneration threshold, hearing damage is recorded and, when the audio signal's decibel level is below the regeneration threshold, hearing repair is recorded. System 200 includes headphones 204 coupled to an audio source 202 for receiving analog audio signals.

Headphones 204 includes variable gain amplifier (VGA) 210 with a first input coupled to audio source 202 for receiving audio signals, a gain control input, and an output coupled to a speaker 212. VGA 210 is configured to scale the amplitude of the audio signals and to provide the scaled audio signals to speaker 212, which generates an acoustic signal and provides it to the user. The output of VGA 210 is also optionally coupled to delay 214, which is utilized in a feedback loop including an analog comparator 224, a threshold indicator 230, a transistor 222, a pulse generator 226, an energy storage element 218 (such as an integrator or capacitor), a switch 220, and a power source 216 to provide stability for the system 200. Delay 214 slows the rate at which volume adjustments happen.

Analog comparator 224 includes a first input coupled to an output of delay 214, a second input coupled to the threshold indicator 230, and an output coupled to a terminal of transistor 222. Threshold indicator 230 is a signal that represents the regeneration threshold for use by analog comparator 224 to determine if the scaled audio signal is above or below the threshold. Analog comparator 224 is further coupled to transistor 222 to increase the resistance level of transistor 222 as the charge on energy storage element 218 increases. In this way, the rate of charge increase on energy storage element 218 is variable to correctly model the rate at which the user undergoes hearing damage at different acoustic amplitudes. When the scaled audio signal exceeds the threshold indicator 230, analog comparator 224 provides an output signal to transistor 222, which biases energy storage element 218.

Energy storage element 218 operates as a damage counter by producing an output signal to adjust the gain of VGA 210. Energy storage element 218 may be an integrator, capacitor, or other storage element. In the following discussion, energy storage element 218 is described as a capacitor. However, it should be understood that system 200 operates in a similar manner if energy storage element 218 is an integrator, where the integrator stores energy instead of charge. Energy storage element 218 is coupled to switch 220 which is turned on and off by pulse generator 226 to couple energy storage element 218 to power source 216 according to timing of the generated pulses. Energy storage element 218 receives its charge from power source 216 when switch 220 is closed. When transistor 222 is turned on, charge stored in energy storage element 218 flows to ground 228 through transistor 222 and the rate of current flow is dependent on the signal level/voltage applied to the gate of transistor 222, which level is set by the output of analog comparator 224. If the scaled audio signal has a decibel level that is above the threshold indicator 230, analog comparator 224 turns on current flow through transistor 222 and current flows from energy storage element 218 through transistor 222 to ground. Energy storage element 218 is further coupled to VGA 210, and based on the charge held within energy storage element 218, controls the gain of VGA 210 to scale the audio signal.

In one example, an audio signal is received at the input of VGA 210. VGA 210 scales the amplitude of the audio signal to produce a scaled audio signal at its output, which is then provided to speaker 212 for reproduction for the user. The scaled audio signal is also received by analog comparator 224, which compares the adjusted signal to threshold indicator 230. If the scaled audio signal is above threshold indicator 230, analog comparator 224 generates a control signal to decrease the resistance of transistor 222, allowing more current to flow from energy storage element 218 through transistor 222 to ground. If, however, the scaled audio signal is below threshold indicator 230, analog comparator 224 controls transistor 222 to decrease or turn off current flow through transistor 222, allowing less charge to escape from energy storage element 218 to ground 228. Thus, the charge recorded by energy storage element 218 is consumed at varying rates dependent on the decibel level at which the scaled audio signal is received by analog comparator 224 and dependent on the level at which the threshold indicator 230 is set.

Energy storage element 218 models the human ear in a manner similar to the way damage counter 124 in FIG. 1. In particular, the charge held by energy storage element 218 can be used to model damage remaining before permanent damage is incurred. It is important to note that energy storage element 218 receives a charge from power source 216 when switch 220 is closed. Switch 220 is pulsed on and off by pulse generator 226 at a rate that provides a controlled charge/discharge rate for the capacitor that is selected to model the normal hearing repair rate of the human ear. Therefore, it should be understood that, by changing the pulse rate of pulse generator 226, the rate at which energy storage element 218 stores charge and discharges it can be varied to provide additional adaptability of system 200, such as to extend beyond a model of damage/repair profile of the human ear. Further the rate of the pluses may be programmed to provide additional functionality.

Thus, system 200 utilizes energy storage element 218 as an analog imitation of the regeneration and damage rate of the human ear, and system 200 can be configured to control the scaled analog signal based on damage sustained by the user's hearing over the period of time the user uses headphones 204 to prevent permanent hearing damage. Thus, the system 200 actively scales the amplitude or volume level of the audio signal as the user consumes the allowable dosage for the day as represented by the charge on energy storage element 218.

As the user listens to the audio signal at a level above the regeneration threshold, the amount of charge being drained from energy storage element 218 is increased above the level at which the charge is replenished, causing the overall charge on energy storage element 218 to decrease. As the charge decreases, energy storage element 218 will control VGA 210 to decrease the amplitude of the audio signal, such that the scaled audio signal will have a lower volume and thus a lower sound pressure level than the original audio signal, and the scaled audio signal will be delivered to the user through speaker 212. The gain of VGA 210 is directly related to the amount of charge remaining in energy storage element 218. By altering the relationship between charge on energy storage element 218 and the gain of VGA 210, different correction curves can be generated by system 200.

VGA 210 may eventually lower the audio signal's amplitude to a decibel level below that of threshold indicator 230. This can happen if either the charge on energy storage element 218 reaches zero or the charge reaches a predetermined amount. For example, system 200 may reserve part of the repairable hearing damage that the user's ear can sustain for consumption by the user while not using system 200. Therefore the charge level at which VGA 210 reduces the audio signal's amplitude to a decibel level below that of threshold indicator 230 could be at a charge level representing an acoustic dosage of approximately 90% of the allowable daily allotment, leaving 10% of the repairable hearing damage.

It should be understood that the above-described system is only one possible analog embodiment, and that it is contemplated that other systems could be devised using additional analog comparators and/or resistors. For example by adding a second comparator between transistor 222 and analog comparator 224, system 200 could accommodate an acceptable safe level indicator and threshold indicator 230, where the acceptable safe level indicator is a sound pressure level where the user could listen to audio signals for a 24 hour period and only consume 1% of the allowable dosage (where the allowable dosage is the amount of exposure to acoustic signals that a user can experience before permanent hearing impairment occurs). Thus setting the minimum volume level to a higher decibel value than that of threshold indicator 230. In another example, multiple resistors or transistors could be utilized to provide a stepped function as described in the description of FIG. 1. In still another embodiment, the pulse generator 226 can be configured to operate with other circuitry to produce a ramp or step function and/or an analog-to-digital converter to control the gain of VGA 210 incrementally.

Figure 3:
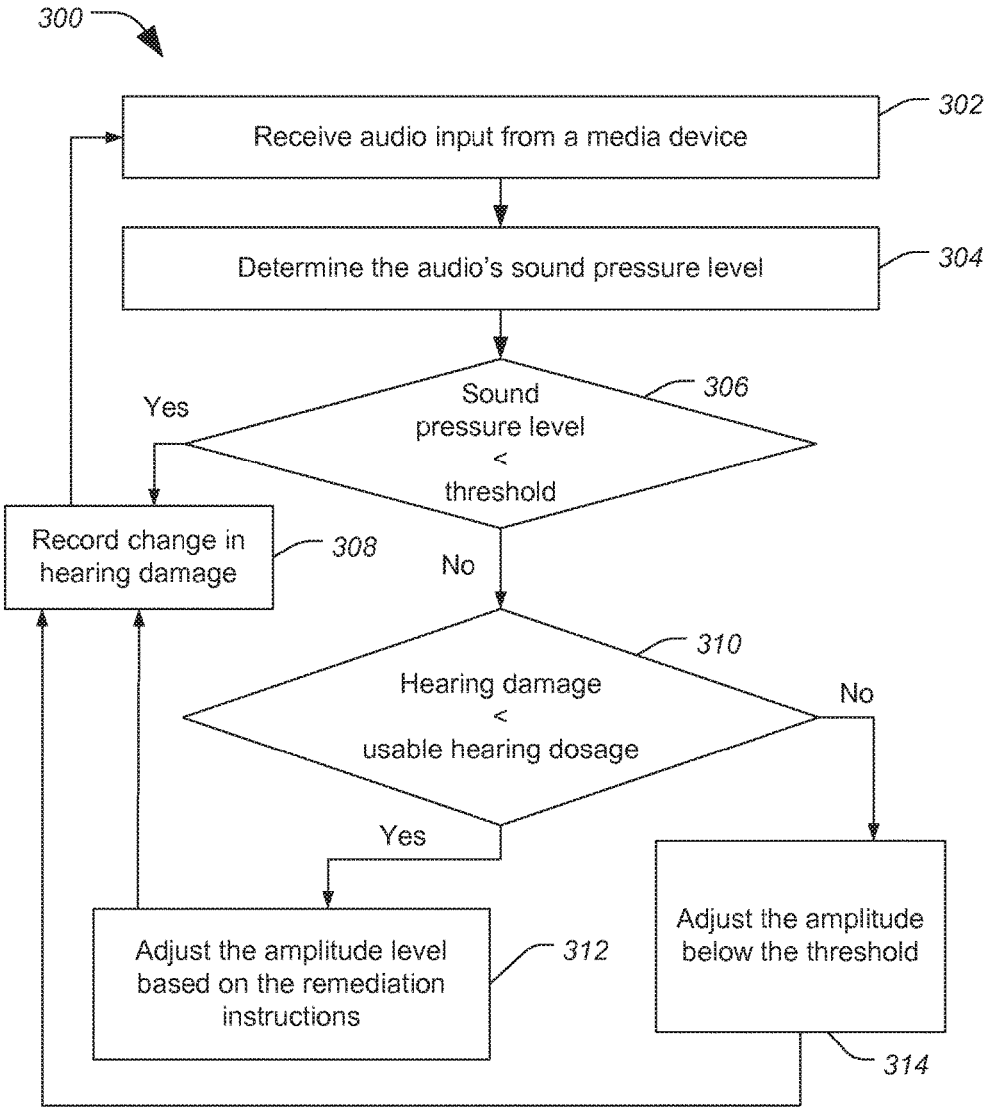
FIG. 3 is a flow diagram of an embodiment of a method of limiting hearing damage by controlling a headphone system, such as the headphone systems of FIGS. 1 and 2.

FIG. 3 is a flow diagram of an embodiment of a method 300 of limiting the hearing damage caused by headphone, which can he implemented to control headphones 102 or 204 in FIGS. 1 and 2. At 302, an audio input is received from a media device. Proceeding to 304, headphones (such as headphones 102 or 204) determine the audio's sound pressure level. Advancing to 306, if the sound pressure level is below a threshold, method 300 advances to 308 and the change in the hearing damage is recorded. In this case, the hearing damage is increased. After the hearing damage change is recorded, method 300 returns to 302 and continues to receive the audio input from the media device.

If, however, at 306 the sound pressure level exceeds the threshold, method 300 advances to 310 and, if the hearing damage is less than usable hearing dosage, the method advances to 312 and the amplitude level of the output signal is adjusted based on remediation instructions. The usable hearing dosage is the amount of hearing damage that the user has sustained by using the headphone system. Thus the usable hearing dosage is a percentage of the damage threshold 122 of FIG. 1 that method 300 may consume.

At 310, if the hearing damage is greater than the usable hearing dosage, method 300 proceeds to 314 and the amplitude of the audio signal is adjusted to a level that is below the threshold. If, however, the hearing damage is less than the usable hearing dosage, the method 300 advances to 312 and adjusts the amplitude level based on the remediation instructions. The amplitude could be adjusted by the remediation instructions in a variety of ways and, in particular, in the manners described above with respect to FIGS. 1 and 2.

Once method 300 adjusts the amplitude either according to the remediation instructions or below the threshold, method 300 advances to 308 and records the change in the hearing damage. If the sound pressure level was above the threshold then the hearing damage sustained is decreased, but if the sound pressure level was above the threshold, the hearing damage is increased. After the change in hearing damage is recorded, method 300 returns to 302 and the cycle begins again with another audio signal.

It should be appreciated that, while the above-discussion has focused on amplitude of the audio signals, the techniques and systems described above may also be used to adjust other audio parameters, such as tone, pitch, bass, and other parameters. To the extent that certain parameters are determined to increase the rate of damage to the hearing, it may be useful to selectively adjust one or more acoustic parameters, including amplitude, pitch, tone, frequency, and other parameters, without substantially altering the content of the audio signal, thereby reducing the effects of prolonged exposure and (preferably) preventing permanent damage to the hearing of the user.

Figure 4:
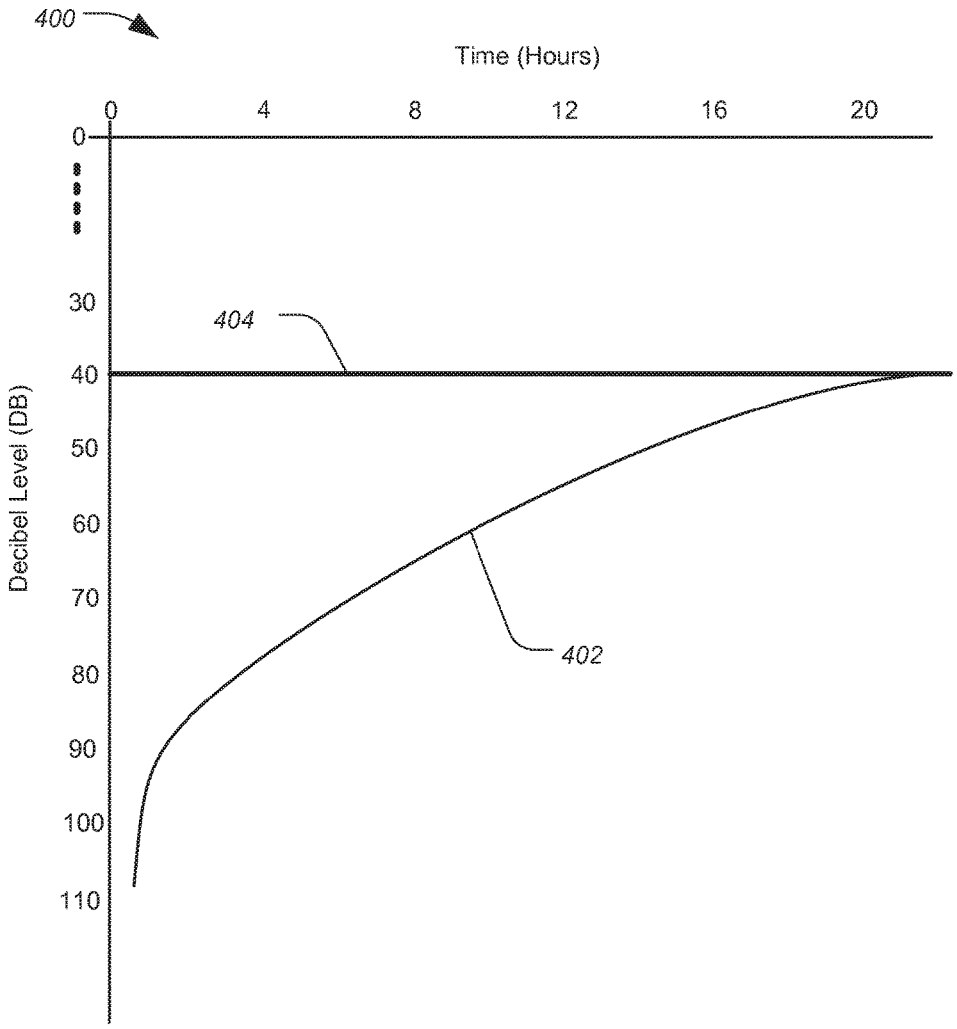
FIG. 4 is a graph illustrating an embodiment of a possible representative sound adjustment curve, which can be generated to protect the user's hearing using the systems depicted in FIGS. 1-3.
Figure 5:
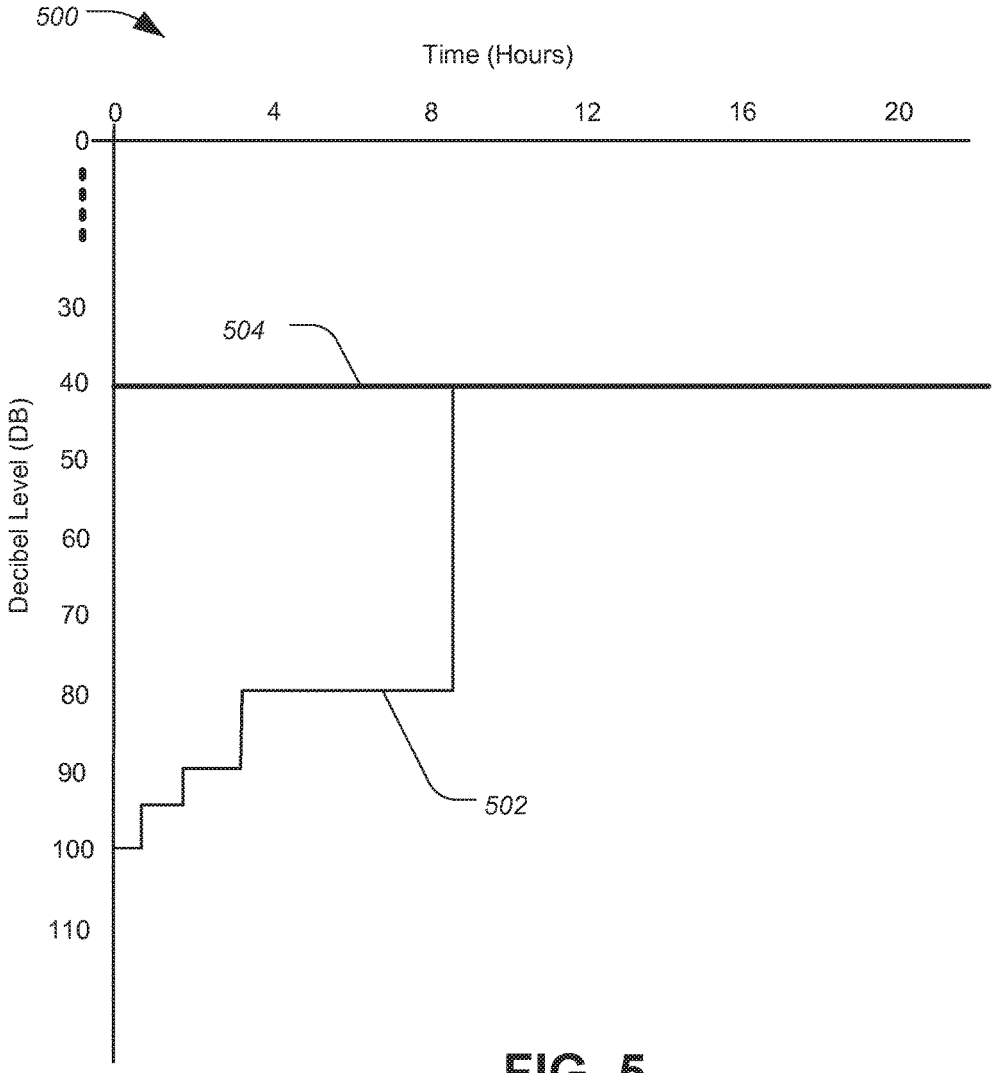
FIG. 5 is a graph illustrating an embodiment of a second possible representative sound adjustment curve, which can be generated to protect the user's hearing using the systems depicted in FIGS. 1-3.
Figure 6:
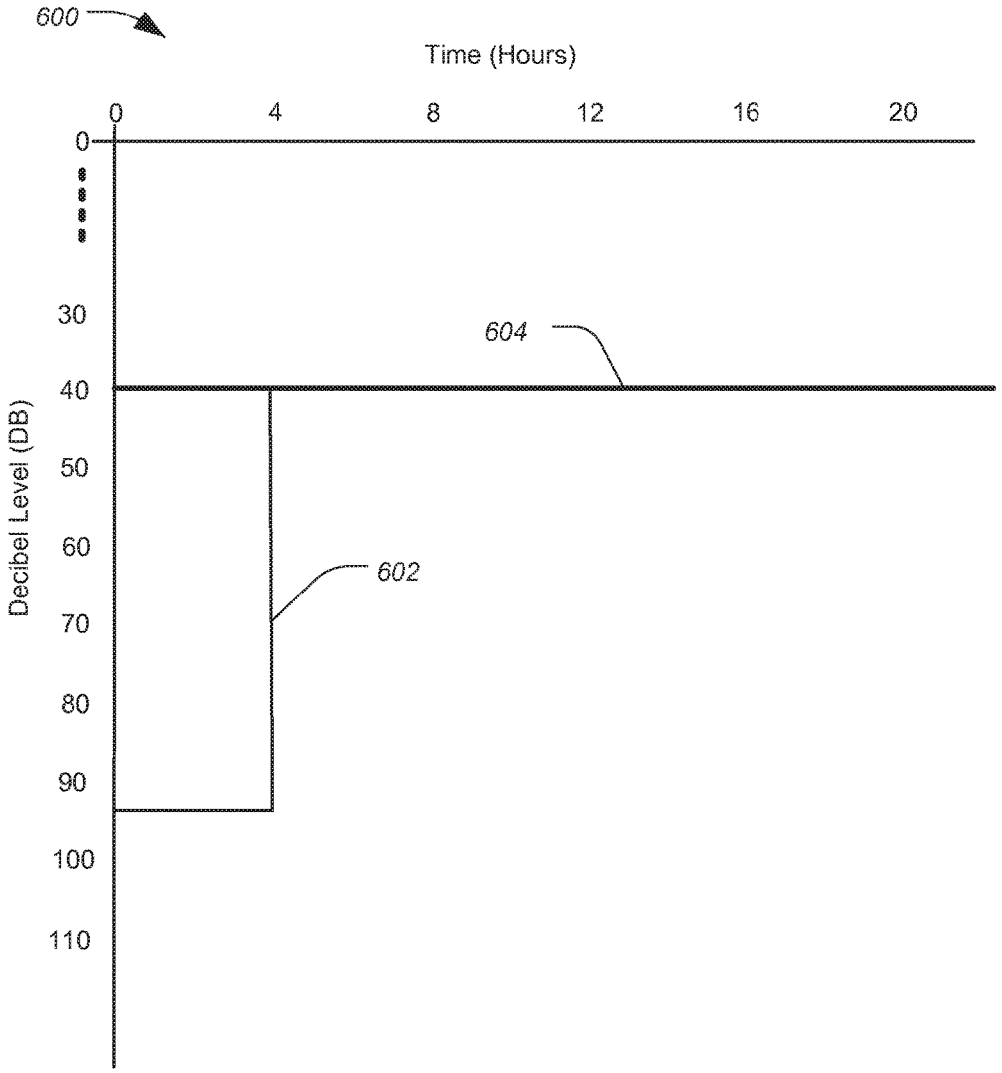
FIG. 6 is a graph illustrating an embodiment of a third possible representative sound adjustment curve, which can be generated to protect the user's hearing by using systems depicted in FIGS. 1-3.

FIGS. 1-3 depict several embodiments of a headphone system that monitors and protects the user from permanent hearing damage. FIGS. 4-6 are illustrative embodiments of various sound adjustment curves that the systems in FIGS. 1-3 could utilize to adjust the amplitude of the headphones in order to protect the user's hearing.

FIG. 4 is a graph 400 illustrating an embodiment of a possible representative amplitude adjustment curve, which can be generated to protect the user's hearing. Graph 400 depicts adjustment curve 402 and threshold 404. Threshold 404 can be set to various sound pressure levels. In this embodiment, threshold 404 is set to 40 decibels. In a particular example, threshold 404 is selected as a safe acoustic level at or below which the user's hearing may regenerate or recover from temporary hearing impairment caused by exposure to hearing damaging acoustic signals.

Adjustment curve 402 is generated when processor 110 executes remediation instructions 127. Adjustment curve 402 is determined by a number of pre-programmed or user adjustable variables including, but not limited to, listening time, starting amplitude, and the current state of damage counter 124. In this example, processor 110 executes remediation instructions 127 upon activation of headphones 102 and calculates a continuous curve that would allow the user to listen to headphones 102 for 20 hours continuously without damaging the user's hearing. In this embodiment, processor 110, in conjunction with remediation instructions 127, takes an active role in determining the amplitude of the sound generated by headphones 102 over time, and adjustment curve 402 depicts a continuous and gradual reduction of the amplitude of the acoustic signals over time. While the adjustment curve 402 represents one possible adjustment, by altering the variables, many different continues curves can be provided.

While FIG. 4 illustrates a continuous sound amplitude adjustment curve, other types of curves or signal shapes may be used to achieve the desired effect, such as the interval step function shown in FIG. 5.

FIG. 5 is a graph 500 illustrating an embodiment of a second possible representative sound adjustment curve, which can be generated to protect the user's hearing using the systems discussed with respect to FIGS. 1-4. Graph 500 depicts an adjustment curve 502 with multiple steps for adjusting the audio signal amplitude and depicts a threshold 504. Threshold 504 can be set to various decibel levels as discussed in FIG. 4. As in FIG. 4, in the illustrated embodiment of FIG. 5, threshold 504 is set to 40 decibels.

However, unlike in FIG. 5, the adjustment curve 502 is configured to include multiple steps or intervals through which the acoustic signals can be adjusted incrementally over time. Thus, adjustment curve 502 is generated to have any number of desired steps. Further, the number of steps can be based, in part, on the amplitude of the sound for each step, total listening time, and the starting amplitude. Based on the number of steps desired, the user may listen to each step for a specific period of time. For example, FIG. 5 shows adjustment curve 502 with four steps. In this instance, processor 110 adjusts the volume incrementally according to the adjustment curve when damage counter 124 is equal to a percentage (⅕th, ⅖ths, 3/5ths, ⅘ths and 5/5ths) of damage threshold 122 by incrementally reducing the decibel level of the output toward safe decibel level. By altering the number of steps, the granularity of the adjustment can be made finer or more course. Further, the number of transitions determines the period of time over which the user may listen to the acoustic signal at the particular output level before the next step reduction is implemented. By incrementally adjusting the acoustic signal, the overall amount of time that the user can listen to the audio signal without incurring hearing damage can be extended.

FIG. 6 is a graph 600 illustrating an embodiment of a third possible representative sound adjustment curve, which can be generated to protect the user's hearing by the systems discussed in FIGS. 1-4. Graph 600 depicts adjustment curve 602 and threshold 604. Threshold 604 can be set to various decibel levels as discussed in FIGS. 4 and 5. As in FIGS. 4 and 5 in this embodiment, threshold 504 is set to 40 decibels.

Adjustment curve 602 depicts a step function, which allows the user to listen to sound at any level they desire until damage counter 124 is approximately equal to damage threshold 122. When the damage threshold 122 is reached, the adjustment curve 602, in conjunction with remediation instructions 127 executed by processor 110, causes the processor 110 to decrease amplitude of the audio signal abruptly to a decibel level that is below threshold 604.

It should be appreciated that other adjustment curves may also be used. For example, an adjustment curve could be a sloped line that decreases linearly over time. In another example, the adjustment curve may be an exponential decay curve. In still another example, the adjustment curve may include components of each of the above types of curves, forming a composite curve that takes different types of remediation actions at different times during the period over which the user is listening to the audio signal. Such different actions may be based on the amount of time, the current audio level, the amount of damage, or any combination thereof.

In conjunction with the systems and methods described above with respect to FIGS. 1-6, a headphone system is disclosed that is configured to monitor sound levels produced by the speaker of the headphones system and to selectively scale the audio signal over time, incrementally, or abruptly to safe audio levels to prevent permanent damage to the user's hearing. In an example, the amount of time that a user has listened to audio signals that exceed a safe or regeneration threshold level is counted and the hearing damage is calculated to determine a current state of the user's hearing. When the hearing damage approaches or exceeds one or more pre-determined thresholds, the audio signal can be automatically scaled to a lower decibel level to slow the rate of damage or to prevent any further damage to the user's hearing.

Although the present invention has been described with reference to preferred embodiments, workers skilled in the art will recognize that changes may be made in form and detail without departing from the scope of the invention.

What is claimed is:

1. A device comprising:

a processor operable to receive and generate an audio signal;

a memory having instructions that, when executed by the processor, cause the processor to:

monitor a sound pressure level;

determine an estimated amount of hearing damage based on an associated amount of time during which the sound pressure level exceeds a hearing damage sound pressure threshold level;

determine an estimated amount of hearing regeneration based on an associated amount of time during which the sound pressure level is less than or equal to the hearing damage sound pressure threshold level;

update a damage counter value based on the estimated amount of hearing damage and the estimated amount of hearing regeneration; and generate and execute, before the damage counter value is equal to a hearing damage threshold, an adjusted audio signal comprising a gradual decrease in a sound pressure output level, the decrease being proportional to the distance between the damage counter value and the hearing damage threshold; and a speaker coupled to the processor and operable to output the adjusted audio signal.

2. The device of claim 1, wherein the memory further includes instructions that cause the processor to calculate, when the sound pressure level is less than the hearing damage threshold, a regeneration rate of hearing by a human ear and reduce the damage counter value based on the regeneration rate.

3. The device of claim 1, wherein the hearing damage threshold corresponds to an amount of hearing damage a user may sustain before experiencing permanent hearing damage.

4. The device of claim 1, wherein the memory further includes instructions that cause the processor to adjust an amplitude of the audio signal using an exponential decay curve.

5. The device of claim 1, wherein the memory further includes instructions that cause the processor to adjust an amplitude of the audio signal using a linear function.

6. The device of claim 1, wherein the memory further includes instructions that cause the processor to adjust an amplitude of the audio signal using a step function.

7. A computer program product comprising a non-transitory computer readable storage medium storing computer usable program code executable to adjusting an audio signal, comprising:

determining, during a period time, a sound pressure level of sound output from a speaker;

calculating an accumulated regeneration amount based on a portion of a period of time of when the sound pressure level is less than a hearing damage sound pressure threshold level;

calculating an accumulated damage amount based on another portion of the period of time of when the sound pressure level exceeds the hearing damage sound pressure threshold level; and generating and executing, before a damage counter value is equal to a hearing damage threshold, an adjusted audio signal having a gradual decrease in an output sound pressure level, the decrease being proportional to the distance between the damage counter value and the hearing damage threshold.

8. The computer program product of claim 7, wherein calculating the accumulated regeneration amount is based at least in part on a regeneration rate of hearing by a human ear.

9. The computer program product of claim 7, further comprising outputting the adjusted audio signal before the accumulated damage amount exceeds the accumulated regeneration amount.

10. The computer program product of claim 9, wherein the hearing damage threshold corresponds to an amount of hearing damage the user's ear may sustain before experiencing permanent hearing damage.

11. The computer program product of claim 10, wherein generating the adjusted audio signal further comprises reducing an amplitude of the audio signal by a plurality of increments, and wherein individual ones of the plurality of increments correspond to a predetermined portion of the hearing damage threshold.

12. The computer program product of claim 7, wherein generating the adjusted audio signal further comprises adjusting an amplitude of the audio signal using an exponential decay curve.

13. The computer program product of claim 7, wherein generating the adjusted audio signal further comprises adjusting an amplitude of the audio signal using a step function.

14. The computer program product of claim 7, further comprising outputting the adjusted audio signal to the speaker carried by a listening device.

15. A method of operating a listening device, the method comprising:

measuring a sound pressure level of an audio signal output from the listening device;

estimating an amount of hearing damage based on an associated amount of time during which the sound pressure level exceeds a hearing damage sound pressure threshold level;

estimating an amount of hearing regeneration based on an associated amount of time during which the sound pressure level is less than or equal to the hearing damage sound pressure threshold level;

updating a damage counter value based on the estimated amount of hearing damage and the estimated amount of hearing regeneration; and adjusting the audio signal before the damage counter value exceeds hearing damage threshold, the adjusted audio signal providing a gradual decrease in a sound pressure output level proportional to the distance between the damage counter and the hearing damage threshold.

16. The method of claim 15, wherein adjusting the audio signal comprises adjusting an amplitude of the audio signal in a series of steps.

17. The method of claim 16, wherein at least one of the series of steps is at a sound pressure below the hearing damage threshold.

18. The method of claim 15, wherein a size of the adjustment of the audio signal includes adjustment of an amplitude of the audio signal based at least in part on a rate of change of the damage counter value.

19. The method of claim 15, wherein adjusting the audio signal comprises applying an exponential decay function to the audio signal.

20. The method of claim 15, wherein adjusting the audio signal comprises applying a linear function to the audio signal.

* * * * *